US008072299B2

(12) United States Patent
Chen et al.

(10) Patent No.: US 8,072,299 B2
(45) Date of Patent: Dec. 6, 2011

(54) FILTER

(75) Inventors: Wen-Hua Chen, Beijing (CN); Zheng-He Feng, Beijing (CN); Ping-Yang Chuang, Taipei Hsien (TW)

(73) Assignees: Tsinghua University, Beijing (CN); Hon Hai Precision Industry Co., Ltd., Tu-Cheng, New Taipei (TW)

( * ) Notice: Subject to any disclaimer, the term of this patent is extended or adjusted under 35 U.S.C. 154(b) by 514 days.

(21) Appl. No.: 12/248,795

(22) Filed: Oct. 9, 2008

(65) Prior Publication Data

US 2009/0195331 A1 Aug. 6, 2009

(30) Foreign Application Priority Data

Feb. 1, 2008 (CN) ..... 2008 1 0066049

(51) Int. Cl.
*H01P 1/208* (2006.01)
*H01P 7/06* (2006.01)

(52) U.S. Cl. ..... 333/212; 333/230

(58) Field of Classification Search ..... 333/208–212, 333/219, 222–235; 977/724, 734, 742, 743, 977/750–752, 809–811
See application file for complete search history.

(56) References Cited

U.S. PATENT DOCUMENTS 2,761,106 A * 8/1956 Posin ..... 333/232
5,329,687 A * 7/1994 Scott et al. ..... 29/527.2
7,129,467 B2 * 10/2006 Wincheski et al. ..... 250/214.1
2005/0238288 A1 * 10/2005 Crutchfield ..... 385/50

OTHER PUBLICATIONS

Raychowdhury, "Modeling of Metallic Carbon-Nanotube Interconnects for Circuit Simulations and a Comparison with Cu Interconnects for Scaled Technologies", Jan. 2006, IEEE, vol. 25, No. I, p. 58.*

* cited by examiner

*Primary Examiner* — Robert Pascal
*Assistant Examiner* — Gerald Stevens
(74) *Attorney, Agent, or Firm* — Altis Law Group, Inc.

(57) ABSTRACT

A filter includes: a container; at least one barrier, an input device and an output device. The at least one barrier divide the container into at least two resonant cavities. Each resonant cavity has a harmonic oscillators disposed therein. At least one of the harmonic oscillators comprises a supporter and a carbon nanotube structure disposed on a surface of the supporter.

9 Claims, 2 Drawing Sheets

FILTER

BACKGROUND

1. Field of the Invention

The present invention generally relates to filters, and particularly, relates to a carbon nanotube based filter.

2. Discussion of Related Art

Filters are important in radio-technology. Referring to FIG. 2, a conventional filter 10 includes a container 102, a wall 114 dividing the space in the container 102 into two resonant cavities 104 each having a harmonic oscillator 106 disposed therein, an input device 108 disposed in one cavity 104 and an output device 110 disposed in the other cavity 104.

In the conventional filter 10, the harmonic oscillator 106 is a hollow cylinder. The bottom of the harmonic oscillator 106 is fixed to the bottom of the container 102 with a bolt. The harmonic oscillator 106 is made of ceramic or metal. However, the ohmic loss of the harmonic oscillator 106 is high if ceramic is used because of the large resistance of the ceramic, or it will be heavy if metal is used.

What is needed, therefore, is a lightweight filter with low ohmic loss.

BRIEF DESCRIPTION OF THE DRAWINGS

Many aspects of the present filter can be better understood with reference to the following drawings. The components in the drawings are not necessarily drawn to scale, the emphasis instead being placed upon clearly illustrating the principles of the present filters.

Figure 1:
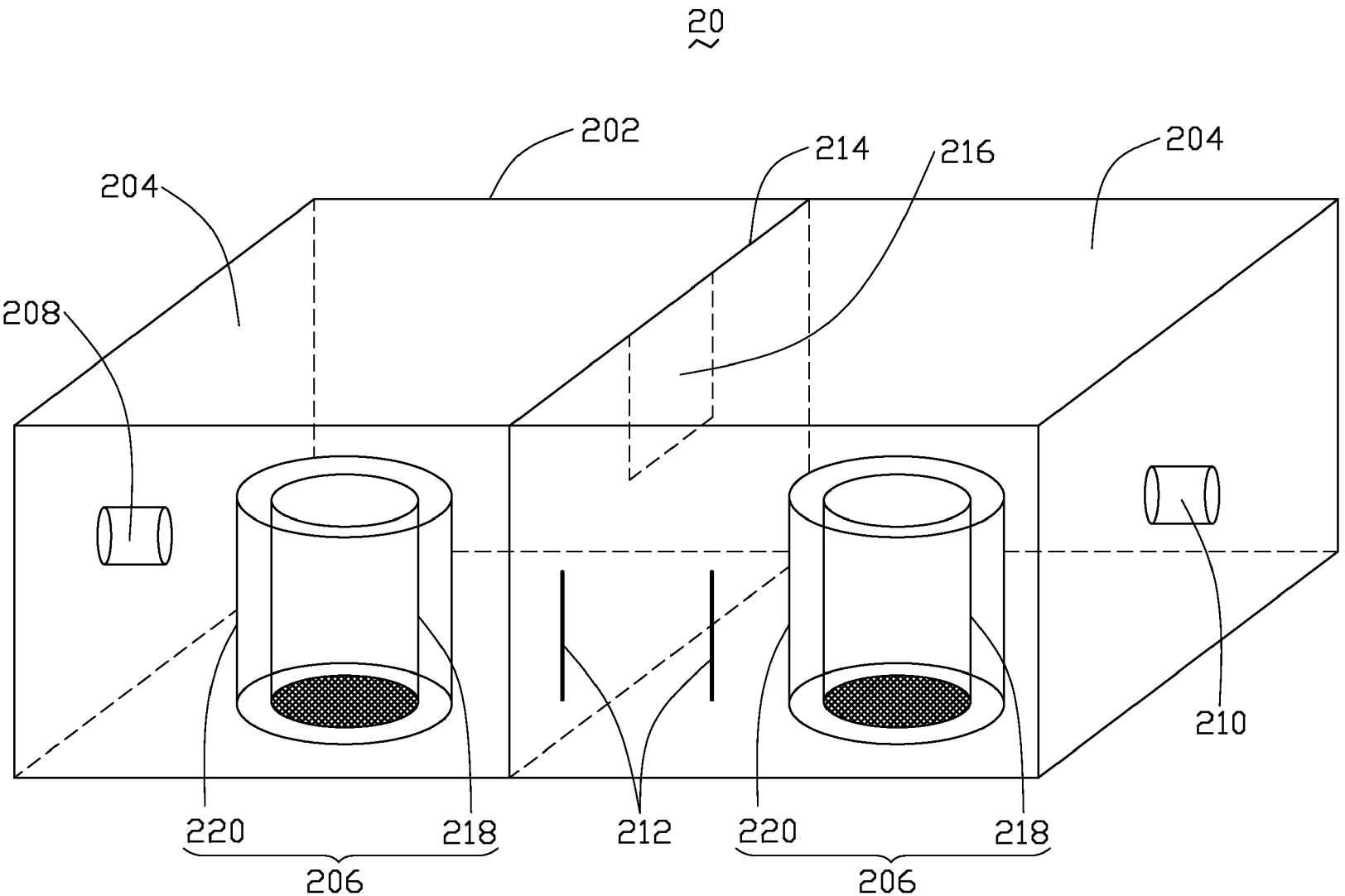
FIG. 1 is a schematic view of a filter in accordance with the present embodiment.
Figure 2:
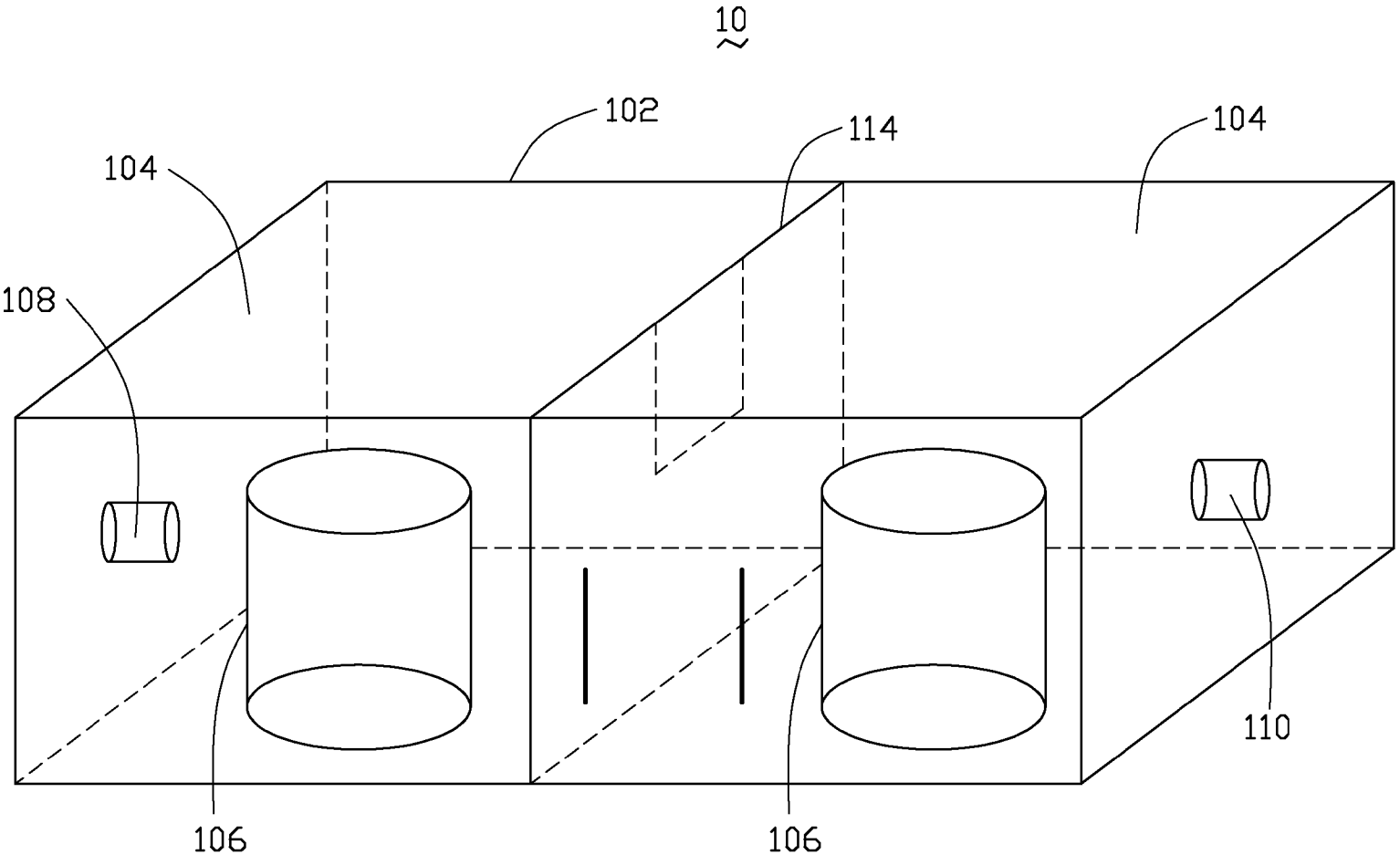
FIG. 2 (PRIOR ART)
FIG. 2 is a schematic view of a conventional filter according to the prior art.

Corresponding reference characters indicate corresponding parts throughout the several views. The exemplifications set out herein illustrate at least one present embodiment of the filter, in at least one form, and such exemplifications are not to be construed as limiting the scope of the invention in any manner.

DETAILED DESCRIPTION OF EXEMPLARY EMBODIMENTS

References will now be made to the drawings, in detail, to describe embodiments of the filter.

Referring to FIG. 1, a filter 20 is provided in the present embodiment. The filter 20 includes a container 202, a barrier 214, at least one harmonic oscillator 206, an input device 208 and an output device 210. The barrier 214 divides the space in the container 202 into two resonant cavities 204. Each of the resonant cavities 204 has a harmonic oscillator 206 disposed therein. The harmonic oscillator 206 is fixed to the bottom surface of the resonant cavities 204. The input device 208 is disposed in one resonant cavity 204 and the output device 210 is disposed in the other resonant cavity 204. At least one of the harmonic oscillators 206 includes a supporter 218 and a carbon nanotube structure 220 disposed on a surface of the supporter 218. An opening 216 is defined in the barrier 214 to achieve capacitance coupling between the two resonant cavities 204. Furthermore, at least one frequency modulation device 212 is disposed in at least one of the resonant cavities 204 to control frequency of the filter 20.

The shape of container 202 is arbitrary, such as hollow cube, prism or cylinder. The volume of the container 202 is arbitrary and can be selected according to need. The material of the container 202 is metal or alloy. In the present embodiment, the container 202 is a hollow cuboid. A length of the container 202 ranges from approximately 2 centimeters to 20 centimeters. A width of the container 202 ranges from approximately 1 centimeter to 10 centimeters. A height of the container 202 ranges from approximately 1 centimeter to 10 centimeters. The material of the container in the present embodiment 202 is aluminum. Furthermore, a metal plating layer (not shown) can be formed on a surface of the container 202 to inhibit intermodulation distortion. In the present embodiment, the metal plating layer is a silver or copper film.

The barrier 214 is a metal or alloy wall. The barrier 214 and the container 202 are formed together by moulding. The thickness of the barrier 214 is arbitrary, and can be selected according to the volume of the container 202 and the resonant cavity 204. The resonant frequency of the resonant cavity 204 is related to the volume of the container 202 and the thickness of the barrier 214. In the present embodiment, the thickness of the barrier 214 ranges from approximately 5 millimeters to 2 centimeters. The barrier 214 is an aluminum plate. The opening 216 is optional and can be defined generally in the top center of the barrier 214. Furthermore, a capacitance coupling device (not shown) may be located at the opening 216 to change the capacitance coupling frequency between the two resonant cavities 204. It is to be understood that the filter 20 can include several barriers 214 to divide the space in the container 202 in to several resonant cavities 204. Also, the barrier 214 may be omitted, in which container, the container 202 defines a single resonant cavity 204.

The each resonant cavity 204 is a closed space. The shape of the cavity 204 can be cube, cuboid, cylinder or other suitable shape chosen as needed. The volume of the resonant cavity 204 is arbitrary, and can be selected according to need. In the present embodiment, the resonant cavity 204 is a cube. The length of side ranges from approximately 1 centimeter to 8 centimeters. The filter 20 can include one or more resonant cavities 204. The resonant cavities 204 can be connected in series or parallel with each other while the filter 20 include two or more resonant cavities 204. The resonant cavities 204 achieve capacitance coupling via the opening 216 and/or capacitance coupling devices.

The supporter 218 is a hollow or solid cube, cuboid, cylinder or other suitable shape. The size of the supporter 218 is arbitrary, and can be selected according to need. In the present embodiment, the supporter 218 is a hollow cylinder with a bottom surface fixed to the inside surface of the container 202 at a central portion of the corresponding resonant cavity 204, with a bolt or other fastener. In the present embodiment, a diameter of the supporter 218 ranges from approximately 5 millimeters to 5 centimeters and a length of the supporter 218 ranges from approximately 1 centimeter to 5 centimeters. The supporter 218 is made of insulating such as ceramic or resin. In the present embodiment, the material of the supporter 218 is polytetrafluoroethylene. The supporter 218 is used to support the carbon nanotube structure 220.

The carbon nanotube structure 220 is located on a surface of the supporter 218. The shape of the structure depends on the shape of the supporter 218. It is to be understood that the carbon nanotube structure 220 can be fixed with an adhesive on the outer surface of the supporter 218, or it can be fixed on the inner surface of the supporter 218, when a hollow supporter 218 is used. Length, width and thickness of the carbon nanotube structure 220 are arbitrary, and can be selected according to need. In the present embodiment, the width of the carbon nanotube structure 220 is a little less than or equal to the height of the supporter 218. The larger the width and thickness of the carbon nanotube structure 220, the lower the surface resistance of the carbon nanotube structure 220 will be. The surface resistance of the carbon nanotube structure 220 will influence the impedance of the harmonic oscillator 206 and the energy waste (or energy consumption) of the filter 20. The higher the surface resistance of the carbon nanotube structure 220 is, the greater the amount of energy wasted by the filter 20 will be.

The structure of the carbon nanotube structure 220 is arbitrary. The carbon nanotube structure 220 includes a plurality of carbon nanotubes that can be either orderly or disorderly distributed. The carbon nanotubes in the carbon nanotube structure 220 can be entangled with each other, isotropically arranged, oriented along a same direction, or oriented along different directions. A thickness of the carbon nanotube structure 220 ranges from approximately 0.5 nanometers to 10 millimeters. The carbon nanotube structure 220 can include at least one carbon nanotube string. The carbon nanotube string is wrapped around the surface of the supporter 218 to form the carbon nanotube structure 220. The carbon nanotube string includes a plurality of carbon nanotube joined successively end-to-end by van der Waals attractive force therebetween and are one or more carbon nanotubes in thickness.

In the present embodiment, the carbon nanotube structure 220 includes at least one carbon nanotube film or two or more stacked carbon nanotube films. Adjacent carbon nanotube films connect to each other by van der Waals attractive force therebetween. A thickness of the carbon nanotube film approximately ranges from 0.5 nanometers to 100 micrometers. Each carbon nanotube film includes a plurality of carbon nanotube segments joined successively end-to-end by van der Waals attractive force therebetween. Each carbon nanotube segments includes a plurality of carbon nanotubes closely arranged and in parallel to each other. The carbon nanotubes in the segments have substantially the same length and are arranged substantially in the same direction. The aligned direction of the carbon nanotubes in any two adjacent carbon nanotube films form an angle $\alpha$, where $0 \leqq \alpha \leqq 90°$. The carbon nanotube film structure includes a plurality of micropores distributed in the carbon nanotube structure 220 uniformly. Diameters of the micropores approximately range from 1 to 500 nanometers. It is to be understood that there can be some variation in the carbon nanotube structures 220.

The carbon nanotubes in the carbon nanotube film is selected from the group consisting of single-walled carbon nanotubes, double-walled carbon nanotubes, and multi-walled carbon nanotubes. A diameter of each single-walled carbon nanotube approximately ranges from 0.5 to 50 nanometers. A diameter of each double-walled carbon nanotube approximately ranges from 1 to 50 nanometers. A diameter of each multi-walled carbon nanotube approximately ranges from 1.5 to 50 nanometers. A length of the carbon nanotube approximately ranges from 200 to 900 micrometers.

In the present embodiment, $\alpha$ is equal to 90° and the carbon nanotubes in the carbon nanotube structure 220 are arranged substantially in the same direction. The carbon nanotube structure 220 wraps around the outer surface of the supporter 218. The carbon nanotubes in the carbon nanotube structure 220 are arranged in the wrapping direction. The resistance along the wrapping direction of the carbon nanotube structure 220 is low.

The input device 208 and output device 210 are conductors, such as metal bars. In the present embodiment, the input device 208 and output device 210 are copper bars. The ends of the input device 208 and the output device 210 that extend into the resonant cavities 204 can contact or be kept a distance from the carbon nanotube structure 220. If the filter 20 includes only one resonant cavity 204, the input device 208 and output device 210 are disposed in the same resonant cavities 204 and electrically connected to the different inside surfaces thereof. If the filter 20 includes at least two resonant cavities 204, the input device 208 and output device 210 are respectively disposed in the different resonant cavities 204. Length and diameter of the input device 208 and the output device 210 are arbitrary, and can be selected according to the need. The length of the input device 208 and the output device 210 ranges from approximately 5 millimeters to 3 centimeters and the diameter of the input device 208 and the output device 210 ranges from approximately 1 millimeter to 5 millimeters. The input device 208 and the output device 210 are interchangeable.

The at least one frequency modulation device 212 is kept a distance from the corresponding harmonic oscillator 206, input device 208 and output device 210. In the present embodiment, the same number of frequency modulation devices 212 is disposed in each resonant cavity 204. One end of the frequency modulation device 212 is fixed on the inside surface of the container 202. The other end of the frequency modulation device 212 extends into the resonant cavity 204.

The filter 20 provided in the present embodiment, has the advantages of low ohmic loss and high power capacity because of the low resistance and large specific surface of the carbon nanotube structure 220, is lightweight due to the low density of the carbon nanotube structure 220.

Finally, it is to be understood that the above-described embodiments are intended to illustrate rather than limit the invention. Variations may be made to the embodiments without departing from the spirit of the invention as claimed. The above-described embodiments illustrate the scope of the invention but do not restrict the scope of the invention.

What is claimed is:

1. A filter comprising:

a container;

at least one barrier dividing the container into at least two resonant cavities, each of the at least two resonant cavities having a harmonic oscillator disposed therein, and at least one of the harmonic oscillators comprising a supporter and a carbon nanotube structure disposed on a surface of the supporter, wherein the carbon nanotube structure comprises at least one carbon nanotube film; and an input device and an output device.

2. The filter as claimed in claim 1, wherein a thickness of the at least one carbon nanotube film ranges from approximately 0.5 nanometers to 100 micrometers.

3. The filter as claimed in claim 1, wherein the at least one carbon nanotube film comprises a plurality of carbon nanotube segments joined successively end-to-end by van der Waals attractive force therebetween.

4. The filter as claimed in claim 3, wherein each of the plurality of carbon nanotube segments comprises a plurality of carbon nanotubes closely arranged in parallel to each other, and the plurality of carbon nanotubes in the plurality of carbon nanotube segments have substantially the same length and are arranged substantially in the same direction.

5. The filter as claimed in claim 4, wherein the carbon nanotube structure comprises two or more stacked carbon nanotube films, the aligned direction of the plurality of carbon nanotubes in adjacent carbon nanotube films form an angle $\alpha$, and $0 \leqq \alpha \leqq 90°$.

6. The filter as claimed in claim 4, wherein the plurality of carbon nanotubes is selected from the group consisting of single-walled carbon nanotubes, double-walled carbon nanotubes, and multi-walled carbon nanotubes.

7. The filter as claimed in claim 4, wherein lengths of the plurality of carbon nanotubes range from approximately 200 micrometers to 900 micrometers, and diameters of the plurality of carbon nanotubes range from approximately 0.5 nanometers to 50 nanometers.

8. A filter comprising:

a container;

at least one barrier dividing the container into at least two resonant cavities, each of the at least two resonant cavities having a harmonic oscillator disposed therein, and at least one of the harmonic oscillators comprising a supporter and a carbon nanotube structure disposed on a surface of the supporter, wherein the carbon nanotube structure comprises a plurality of carbon nanotubes entangled with each other; and an input device and an output device.

9. A filter comprising:

a container;

at least one barrier dividing the container into at least two resonant cavities, each of the at least two resonant cavities having a harmonic oscillator disposed therein, and at least one of the harmonic oscillators comprising a supporter and a carbon nanotube structure disposed on a surface of the supporter, wherein a thickness of the carbon nanotube structure ranges from approximately 0.5 nanometers to 10 millimeters; and an input device and an output device.

* * * * *